US008260444B2

(12) United States Patent
Kowald et al.

(10) Patent No.: US 8,260,444 B2
(45) Date of Patent: Sep. 4, 2012

(54) AUXILIARY CONTROLLER OF A HVAC SYSTEM

(75) Inventors: Glenn Will Kowald, Carrollton, TX (US); Darko Hadzidedic, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 318 days.

(21) Appl. No.: 12/707,509

(22) Filed: Feb. 17, 2010

(65) Prior Publication Data

US 2011/0202180 A1 Aug. 18, 2011

(51) Int. Cl.

| | |
|---|---|
| ***G05B 19/18*** | (2006.01) |
| *G01M 1/38* | (2006.01) |
| *G05B 13/00* | (2006.01) |
| *G05B 15/00* | (2006.01) |
| *G05D 23/00* | (2006.01) |
| *G05D 15/00* | (2006.01) |

(52) U.S. Cl. ..... 700/65; 700/66; 700/276; 700/299; 236/76

(58) Field of Classification Search ..... 700/19–20, 700/65–66, 276–278, 299–300; 236/76, 236/91

See application file for complete search history.

(56) References Cited

U.S. PATENT DOCUMENTS

| | | | |
|---|---|---|---|
| 4,296,464 | A | 10/1981 | Woods et al. |
| 4,501,125 | A | 2/1985 | Han |
| 4,694,394 | A | 9/1987 | Costantini |
| 4,698,628 | A | 10/1987 | Herkert et al. |
| 4,703,325 | A | 10/1987 | Chamberlin et al. |
| 4,706,247 | A | 11/1987 | Yoshioka |
| 4,723,239 | A | 2/1988 | Schwartz |
| 4,841,450 | A | 6/1989 | Fredriksson |
| 4,873,649 | A | 10/1989 | Grald et al. |
| 4,884,214 | A | 11/1989 | Parker et al. |
| 4,887,262 | A | 12/1989 | van Veldhuizen |
| 4,888,728 | A | 12/1989 | Shirakawa et al. |
| 4,889,280 | A | 12/1989 | Grald et al. |
| 4,931,948 | A | 6/1990 | Parker et al. |
| 4,941,143 | A | 7/1990 | Twitty et al. |
| 4,942,613 | A | 7/1990 | Lynch |
| 4,947,484 | A | 8/1990 | Twitty et al. |
| 4,947,928 | A | 8/1990 | Parker et al. |
| 4,953,083 | A | 8/1990 | Takata et al. |
| 4,955,018 | A | 9/1990 | Twitty et al. |
| 4,978,896 | A | 12/1990 | Shah |
| 4,991,770 | A | 2/1991 | Bird et al. |

(Continued)

OTHER PUBLICATIONS

Related case U.S. Appl. No. 12/603,450, filed Oct. 21, 2009 to Wojciech Grohman, entitled "Alarm and Diagnostics System and Method for a Distributed-Architecture Heating, Ventilation and Air Conditioning Network".

(Continued)

*Primary Examiner* — Ramesh Patel

(57) ABSTRACT

The disclosure provides an auxiliary controller of a HVAC system, a method of manufacturing a HVAC system, a method of starting a HVAC system and a HVAC system. In one embodiment, the HVAC system includes: (1) a main system controller having a main non-volatile memory and configured to direct operation of the HVAC system and store main controller application information associated therewith on the main non-volatile memory (2) an auxiliary controller having (2A) an interface coupled to the main system controller and configured to communicate therewith, (2B) a processor, coupled to the interface and configured to direct the operation of a component of the HVAC system and (2C) an auxiliary non-volatile memory configured to receive a copy of the main controller application information via the interface and store the main controller application information thereon.

5 Claims, 3 Drawing Sheets

U.S. PATENT DOCUMENTS

| | | | | |
|---|---|---|---|---|
| 4,996,513 | A | | 2/1991 | Mak et al. |
| 5,006,827 | A | | 4/1991 | Brueton et al. |
| 5,018,138 | A | | 5/1991 | Twitty et al. |
| 5,042,997 | A | | 8/1991 | Rhodes |
| 5,058,388 | A | | 10/1991 | Shaw et al. |
| 5,103,896 | A | | 4/1992 | Saga |
| 5,105,366 | A | | 4/1992 | Beckey |
| 5,115,967 | A | | 5/1992 | Wedekind |
| 5,180,102 | A | | 1/1993 | Gilbert et al. |
| 5,181,653 | A | | 1/1993 | Foster et al. |
| 5,184,122 | A | | 2/1993 | Decious et al. |
| 5,191,643 | A | | 3/1993 | Alsenz |
| 5,195,327 | A | | 3/1993 | Kim |
| 5,197,666 | A | | 3/1993 | Wedekind |
| 5,197,668 | A | | 3/1993 | Ratz et al. |
| 5,203,497 | A | | 4/1993 | Ratz et al. |
| 5,220,260 | A | | 6/1993 | Schuler |
| 5,230,482 | A | | 7/1993 | Ratz et al. |
| 5,276,630 | A | | 1/1994 | Baldwin et al. |
| 5,277,036 | A | | 1/1994 | Dieckmann et al. |
| 5,279,458 | A | | 1/1994 | DeWolf et al. |
| 5,297,143 | A | | 3/1994 | Fridrich et al. |
| 5,314,004 | A | | 5/1994 | Strand et al. |
| 5,323,385 | A | | 6/1994 | Jurewicz et al. |
| 5,323,619 | A | | 6/1994 | Kim |
| 5,327,426 | A | | 7/1994 | Dolin, Jr. et al. |
| 5,329,991 | A | | 7/1994 | Mehta et al. |
| 5,337,952 | A | | 8/1994 | Thompson |
| 5,355,323 | A | | 10/1994 | Bae |
| 5,383,116 | A | | 1/1995 | Lennartsson |
| 5,384,697 | A | | 1/1995 | Pascucci |
| 5,414,337 | A | | 5/1995 | Schuler |
| 5,417,368 | A | | 5/1995 | Jeffery et al. |
| 5,420,572 | A | | 5/1995 | Dolin, Jr. et al. |
| 5,440,895 | A | | 8/1995 | Bahel et al. |
| 5,444,626 | A | | 8/1995 | Schenk |
| 5,444,851 | A | | 8/1995 | Woest |
| 5,448,180 | A | | 9/1995 | Kienzler et al. |
| 5,448,561 | A | | 9/1995 | Kaiser et al. |
| 5,449,047 | A | | 9/1995 | Schivley, Jr. |
| 5,452,201 | A | | 9/1995 | Pieronek et al. |
| 5,460,327 | A | | 10/1995 | Hill et al. |
| 5,463,735 | A | * | 10/1995 | Pascucci et al. ..... 709/222 |
| 5,469,150 | A | | 11/1995 | Sitte |
| 5,481,661 | A | | 1/1996 | Kobayashi |
| 5,488,834 | A | | 2/1996 | Schwarz |
| 5,491,649 | A | | 2/1996 | Friday, Jr. et al. |
| 5,502,818 | A | | 3/1996 | Lamberg |
| 5,513,324 | A | | 4/1996 | Dolin, Jr. et al. |
| 5,515,267 | A | | 5/1996 | Alsenz |
| 5,520,328 | A | | 5/1996 | Bujak, Jr. |
| 5,530,643 | A | | 6/1996 | Hodorowski |
| 5,537,339 | A | | 7/1996 | Naganuma et al. |
| 5,539,778 | A | | 7/1996 | Kienzler et al. |
| 5,544,036 | A | | 8/1996 | Brown, Jr. et al. |
| 5,544,809 | A | | 8/1996 | Keating et al. |
| 5,551,053 | A | | 8/1996 | Nadolski et al. |
| 5,555,269 | A | | 9/1996 | Friday, Jr. et al. |
| 5,555,509 | A | | 9/1996 | Dolan et al. |
| 5,559,407 | A | | 9/1996 | Dudley et al. |
| 5,559,412 | A | | 9/1996 | Schuler |
| 5,566,879 | A | | 10/1996 | Longtin |
| 5,572,658 | A | | 11/1996 | Mohr et al. |
| 5,574,848 | A | | 11/1996 | Thomson |
| 5,579,221 | A | | 11/1996 | Mun |
| 5,581,478 | A | | 12/1996 | Cruse et al. |
| 5,592,058 | A | | 1/1997 | Archer et al. |
| 5,592,059 | A | | 1/1997 | Archer |
| 5,592,628 | A | | 1/1997 | Ueno et al. |
| 5,596,437 | A | | 1/1997 | Heins |
| 5,598,566 | A | | 1/1997 | Pascucci et al. |
| 5,600,782 | A | | 2/1997 | Thomson |
| 5,613,369 | A | | 3/1997 | Sato et al. |
| 5,617,282 | A | | 4/1997 | Rall et al. |
| 5,628,201 | A | | 5/1997 | Bahel et al. |
| 5,630,325 | A | | 5/1997 | Bahel et al. |
| 5,634,590 | A | | 6/1997 | Gorski et al. |
| 5,675,830 | A | | 10/1997 | Satula |
| 5,684,717 | A | | 11/1997 | Beilfuss et al. |
| 5,699,243 | A | | 12/1997 | Eckel et al. |
| 5,711,480 | A | | 1/1998 | Zepke et al. |
| 5,720,604 | A | | 2/1998 | Kelly et al. |
| 5,722,822 | A | | 3/1998 | Wilson et al. |
| 5,726,900 | A | | 3/1998 | Walter et al. |
| 5,737,529 | A | | 4/1998 | Dolin, Jr. et al. |
| 5,748,923 | A | | 5/1998 | Eitrich |
| 5,751,572 | A | | 5/1998 | Maciulewicz |
| 5,751,948 | A | | 5/1998 | Dolan et al. |
| 5,754,779 | A | | 5/1998 | Dolin, Jr. et al. |
| 5,761,083 | A | | 6/1998 | Brown, Jr. et al. |
| 5,764,146 | A | | 6/1998 | Baldwin et al. |
| 5,772,326 | A | | 6/1998 | Batko et al. |
| 5,772,732 | A | | 6/1998 | James et al. |
| 5,774,322 | A | | 6/1998 | Walter et al. |
| 5,774,492 | A | | 6/1998 | Orlowsik, Jr. et al. |
| 5,774,493 | A | | 6/1998 | Ross |
| 5,777,837 | A | | 7/1998 | Eckel et al. |
| 5,782,296 | A | | 7/1998 | Mehta |
| 5,786,993 | A | | 7/1998 | Frutiger et al. |
| 5,787,027 | A | | 7/1998 | Dolan et al. |
| 5,791,332 | A | | 8/1998 | Thompson et al. |
| 5,802,485 | A | | 9/1998 | Koelle et al. |
| 5,809,063 | A | | 9/1998 | Ashe et al. |
| 5,809,556 | A | | 9/1998 | Fujisawa et al. |
| 5,816,492 | A | | 10/1998 | Charles et al. |
| 5,818,347 | A | * | 10/1998 | Dolan et al. ..... 340/9.16 |
| 5,819,845 | A | | 10/1998 | Ryu et al. |
| 5,826,038 | A | | 10/1998 | Nakazumi |
| 5,829,674 | A | | 11/1998 | Vanostrand et al. |
| 5,841,654 | A | | 11/1998 | Verissimo et al. |
| 5,848,887 | A | | 12/1998 | Zabielski et al. |
| 5,854,744 | A | | 12/1998 | Zeng et al. |
| 5,856,972 | A | | 1/1999 | Riley et al. |
| 5,860,411 | A | | 1/1999 | Thompson et al. |
| 5,860,473 | A | | 1/1999 | Seiden |
| 5,862,411 | A | | 1/1999 | Kay et al. |
| 5,864,581 | A | | 1/1999 | Alger-Meunier et al. |
| 5,873,519 | A | | 2/1999 | Beilfuss |
| 5,878,236 | A | | 3/1999 | Kleineberg et al. |
| 5,883,627 | A | | 3/1999 | Pleyer |
| 5,892,690 | A | | 4/1999 | Boatman et al. |
| 5,896,304 | A | | 4/1999 | Tiemann et al. |
| 5,900,674 | A | | 5/1999 | Wojnarowski et al. |
| 5,903,454 | A | | 5/1999 | Hoffberg et al. |
| 5,912,877 | A | | 6/1999 | Shirai et al. |
| 5,914,453 | A | | 6/1999 | James et al. |
| 5,915,101 | A | | 6/1999 | Kleineberg et al. |
| 5,927,398 | A | | 7/1999 | Maciulewicz |
| 5,930,249 | A | | 7/1999 | Stademann et al. |
| 5,933,655 | A | | 8/1999 | Vrabec et al. |
| 5,934,554 | A | | 8/1999 | Charles et al. |
| 5,937,942 | A | | 8/1999 | Bias et al. |
| 5,946,209 | A | | 8/1999 | Eckel et al. |
| 5,971,597 | A | | 10/1999 | Baldwin et al. |
| 5,973,594 | A | | 10/1999 | Baldwin et al. |
| 5,983,646 | A | | 11/1999 | Grothe et al. |
| 5,993,195 | A | | 11/1999 | Thompson |
| 6,006,142 | A | | 12/1999 | Seem et al. |
| 6,011,821 | A | | 1/2000 | Sauer et al. |
| 6,021,252 | A | | 2/2000 | Faris et al. |
| 6,028,864 | A | | 2/2000 | Marttinen et al. |
| 6,032,178 | A | | 2/2000 | Bacigalupo et al. |
| 6,035,024 | A | | 3/2000 | Stumer |
| 6,046,410 | A | | 4/2000 | Wojnarowski et al. |
| 6,049,817 | A | | 4/2000 | Schoen et al. |
| 6,053,416 | A | | 4/2000 | Specht et al. |
| 6,061,603 | A | | 5/2000 | Papadopoulos et al. |
| 6,078,660 | A | | 6/2000 | Burgess |
| 6,082,894 | A | | 7/2000 | Batko et al. |
| 6,092,280 | A | | 7/2000 | Wojnarowski |
| 6,095,674 | A | | 8/2000 | Verissimo et al. |
| 6,098,116 | A | | 8/2000 | Nixon et al. |
| 6,101,824 | A | | 8/2000 | Meyer et al. |
| 6,110,260 | A | | 8/2000 | Kubokawa |
| 6,138,227 | A | | 10/2000 | Thewes et al. |
| 6,141,595 | A | | 10/2000 | Gloudeman et al. |
| 6,145,501 | A | | 11/2000 | Manohar et al. |

6,145,751 A 11/2000 Ahmed
6,147,601 A 11/2000 Sandelman et al.
6,151,298 A 11/2000 Bernhardsson et al.
6,151,529 A 11/2000 Batko
6,151,625 A 11/2000 Swales et al.
6,151,650 A 11/2000 Birzer
6,155,341 A 12/2000 Thompson et al.
6,160,477 A 12/2000 Sandelman et al.
6,160,484 A 12/2000 Spahl et al.
6,160,795 A 12/2000 Hosemann
6,167,338 A 12/2000 De Wille et al.
6,169,937 B1 1/2001 Peterson
6,177,945 B1 1/2001 Pleyer
6,179,213 B1 1/2001 Gibino et al.
6,182,130 B1 1/2001 Dolin, Jr. et al.
6,188,642 B1 2/2001 Schoniger et al.
6,190,442 B1 2/2001 Redner
6,208,905 B1 3/2001 Giddings et al.
6,208,924 B1 3/2001 Bauer
6,211,782 B1 4/2001 Sandelman et al.
6,216,066 B1 4/2001 Goebel et al.
6,227,191 B1 5/2001 Garloch
6,232,604 B1 5/2001 McDaniel et al.
6,237,113 B1 5/2001 Daiber
6,252,890 B1 6/2001 Alger-Meunier et al.
6,254,009 B1 7/2001 Proffitt et al.
6,266,205 B1 7/2001 Schreck et al.
6,269,127 B1 7/2001 Richards
6,282,454 B1 8/2001 Papadopoulos et al.
6,285,912 B1 9/2001 Ellison et al.
6,292,518 B1 9/2001 Grabb et al.
6,298,376 B1 10/2001 Rosner et al.
6,298,454 B1 10/2001 Schleiss et al.
6,298,551 B1 10/2001 Wojnarowski et al.
6,304,557 B1 10/2001 Nakazumi
6,324,008 B1 11/2001 Baldwin et al.
6,324,854 B1 12/2001 Jayanth
6,336,065 B1 1/2002 Gibson et al.
6,343,236 B1 1/2002 Gibson et al.
6,349,883 B1 2/2002 Simmons et al.
6,353,775 B1 3/2002 Nichols
6,385,510 B1 5/2002 Hoog et al.
6,390,806 B1 5/2002 Dempsey et al.
6,393,023 B1 5/2002 Shimizu et al.
6,400,996 B1 6/2002 Hoffberg et al.
6,405,104 B1 6/2002 Dougherty
6,408,228 B1 6/2002 Seem et al.
6,411,701 B1 6/2002 Stademann
6,412,435 B1 7/2002 Timmons, Jr.
6,415,395 B1 7/2002 Varma et al.
6,418,507 B1 7/2002 Fackler
6,423,118 B1 7/2002 Becerra et al.
6,424,872 B1 7/2002 Glanzer et al.
6,424,874 B1 7/2002 Cofer
6,429,845 B1 8/2002 Unseld et al.
6,434,715 B1 8/2002 Andersen
6,435,418 B1 8/2002 Toth et al.
6,437,691 B1 8/2002 Sandelman et al.
6,442,952 B2 9/2002 Roh et al.
6,448,896 B1 9/2002 Bankus et al.
6,449,315 B2 9/2002 Richards
6,450,409 B1 9/2002 Rowlette et al.
6,454,177 B1 9/2002 Sasao et al.
6,462,654 B1 10/2002 Sandelman et al.
6,478,084 B1 11/2002 Kumar et al.
6,497,570 B1 12/2002 Sears et al.
6,498,844 B1 12/2002 Stademann
6,504,338 B1 1/2003 Eichorn
6,526,122 B2 2/2003 Matsushita et al.
6,535,123 B2 3/2003 Sandelman et al.
6,535,138 B1 3/2003 Dolan et al.
6,539,489 B1 3/2003 Reinert
6,540,148 B1 4/2003 Salsbury et al.
6,542,462 B1 4/2003 Sohraby et al.
6,543,007 B1 4/2003 Bliley et al.
6,545,660 B1 4/2003 Shen et al.
6,546,008 B1 4/2003 Wehrend
6,554,198 B1 4/2003 Hull et al.
6,560,976 B2 5/2003 Jayanth
6,567,476 B2 5/2003 Kohl et al.
6,572,363 B1 6/2003 Virgil, Jr. et al.
6,574,215 B2 6/2003 Hummel
6,574,234 B1 6/2003 Myer et al.
6,574,581 B1 6/2003 Bohrer et al.
6,575,233 B1 6/2003 Krumnow
6,580,950 B1 6/2003 Johnson et al.
6,587,039 B1 7/2003 Woestemeyer et al.
6,587,739 B1 7/2003 Abrams et al.
6,587,884 B1 7/2003 Papadopoulos et al.
6,595,430 B1 7/2003 Shah
6,600,923 B1 7/2003 Dzuban
6,608,560 B2 8/2003 Abrams
6,609,127 B1 8/2003 Lee et al.
6,615,088 B1 9/2003 Myer et al.
6,615,594 B2 9/2003 Jayanth et al.
6,618,394 B1 9/2003 Hilleary
6,619,555 B2 9/2003 Rosen
6,621,507 B1 9/2003 Shah
6,622,926 B1 9/2003 Sartain et al.
6,628,993 B1 9/2003 Bauer
6,633,781 B1 10/2003 Lee et al.
6,636,771 B1 10/2003 Varma et al.
6,640,145 B2 10/2003 Hoffberg et al.
6,640,890 B1 11/2003 Dage et al.
6,643,689 B2 11/2003 Rode et al.
6,647,317 B2 11/2003 Takai et al.
6,650,949 B1 11/2003 Fera et al.
6,651,034 B1 11/2003 Hedlund et al.
6,658,373 B2 12/2003 Rossi et al.
RE38,406 E 1/2004 Faris et al.
6,681,215 B2 1/2004 Jammu
6,688,387 B1 2/2004 Wellington et al.
6,704,688 B2 3/2004 Aslam et al.
6,708,239 B1 3/2004 Ellerbrock et al.
6,715,120 B1 3/2004 Hladik et al.
6,715,302 B2 4/2004 Ferragut, II
6,715,690 B2 4/2004 Hull et al.
6,717,513 B1 4/2004 Sandelman et al.
6,718,384 B2 4/2004 Linzy
6,722,143 B2 4/2004 Moon et al.
6,725,180 B2 4/2004 Mayer et al.
6,725,398 B1 4/2004 Varma et al.
6,728,369 B2 4/2004 Burgess
6,732,191 B1 5/2004 Baker et al.
6,735,196 B1 5/2004 Manzardo
6,735,282 B2 5/2004 Matsushita et al.
6,735,965 B2 5/2004 Moon et al.
6,738,676 B2 5/2004 Hirayama
6,741,915 B2 5/2004 Poth
6,744,771 B1 6/2004 Barber et al.
6,745,106 B2 6/2004 Howard et al.
6,758,050 B2 7/2004 Jayanth et al.
6,758,051 B2 7/2004 Jayanth et al.
6,763,040 B1 7/2004 Hite et al.
6,763,272 B2 7/2004 Knepper
6,765,993 B2 7/2004 Cueman
6,768,732 B1 7/2004 Neuhaus
6,774,786 B1 8/2004 Havekost et al.
6,779,176 B1 8/2004 Chambers, II et al.
6,783,079 B2 8/2004 Carey et al.
6,789,739 B2 9/2004 Rosen
6,791,530 B2 9/2004 Vernier et al.
6,795,935 B1 9/2004 Unkle et al.
6,798,341 B1 9/2004 Eckel et al.
6,801,524 B2 10/2004 Eteminan
6,804,564 B2 10/2004 Crispin et al.
6,810,333 B2 10/2004 Adedeji et al.
6,814,299 B1 11/2004 Carey
6,814,660 B1 11/2004 Cavett
6,816,071 B2 11/2004 Conti
6,819,802 B2 11/2004 Higgs et al.
6,822,202 B2 11/2004 Atlas
6,823,680 B2 11/2004 Jayanth
6,824,069 B2 11/2004 Rosen
6,826,454 B2 11/2004 Sulfstede
6,826,590 B1 11/2004 Glanzer et al.
6,832,118 B1 12/2004 Heberlein et al.
6,833,844 B1 12/2004 Shiota et al.

6,840,052 B2 1/2005 Smith et al.
6,842,117 B2 1/2005 Keown
6,842,808 B2 1/2005 Weigl et al.
6,845,918 B2 1/2005 Rotondo
6,850,992 B2 2/2005 Heinrich et al.
6,851,948 B2 2/2005 Dempsey et al.
6,853,291 B1 2/2005 Aisa
6,854,444 B2 2/2005 Plagge et al.
6,865,449 B2 3/2005 Dudley
6,865,596 B1 3/2005 Barber et al.
6,865,898 B2 3/2005 Yamanashi et al.
6,866,375 B2 3/2005 Leighton et al.
6,868,900 B2 3/2005 Dage et al.
6,874,693 B2 4/2005 Readio et al.
6,876,891 B1 4/2005 Schuler et al.
6,879,881 B1 4/2005 Attridge, Jr.
6,888,441 B2 5/2005 Carey
6,892,121 B2 5/2005 Schmidt
6,894,703 B2 5/2005 Vernier et al.
6,900,808 B2 5/2005 Lassiter et al.
6,901,316 B1 5/2005 Jensen et al.
6,901,439 B1 5/2005 Bonasia et al.
6,907,329 B2 6/2005 Junger et al.
6,909,948 B2 6/2005 Mollmann et al.
6,918,064 B2 7/2005 Mueller et al.
6,920,318 B2 7/2005 Brooking et al.
6,925,360 B2 8/2005 Yoon et al.
6,931,645 B2 8/2005 Murching et al.
6,938,106 B2 8/2005 Ellerbrock et al.
6,941,193 B2 9/2005 Frecska et al.
6,954,680 B2 10/2005 Kreidler et al.
6,955,060 B2 10/2005 Homan et al.
6,955,302 B2 10/2005 Erdman, Jr.
6,956,424 B2 10/2005 Hohnel
6,957,696 B1 10/2005 Krumnow
6,963,288 B1 11/2005 Sokol et al.
6,963,922 B2 11/2005 Papadopoulos et al.
6,965,802 B2 11/2005 Sexton
6,968,295 B1 11/2005 Carr
6,973,366 B2 12/2005 Komai
6,975,219 B2 12/2005 Eryurek et al.
6,975,913 B2 12/2005 Kreidler et al.
6,975,958 B2 12/2005 Bohrer et al.
6,980,796 B1 12/2005 Cuellar et al.
6,981,266 B1 12/2005 An et al.
6,983,271 B2 1/2006 Morrow et al.
6,983,889 B2 1/2006 Alles
6,988,011 B2 1/2006 Varma et al.
6,988,671 B2 1/2006 DeLuca
6,990,381 B2 1/2006 Nomura et al.
6,990,540 B2 1/2006 Dalakuras et al.
6,993,414 B2 1/2006 Shah
RE38,985 E 2/2006 Boatman et al.
6,994,620 B2 2/2006 Mills
6,999,473 B2 2/2006 Windecker
6,999,824 B2 2/2006 Glanzer et al.
7,000,849 B2 2/2006 Ashworth et al.
7,003,378 B2 2/2006 Poth
7,006,460 B1 2/2006 Vollmer et al.
7,006,881 B1 2/2006 Hoffberg et al.
7,013,239 B2 3/2006 Hedlund et al.
7,017,827 B2 3/2006 Shah et al.
7,020,798 B2 3/2006 Meng et al.
7,022,008 B1 4/2006 Crocker
7,024,282 B2 4/2006 Coogan et al.
7,024,283 B2 4/2006 Bicknell
7,025,281 B2 4/2006 DeLuca
7,029,391 B2 4/2006 Nagaya et al.
7,032,018 B2 4/2006 Lee et al.
7,035,719 B2 4/2006 Howard et al.
7,035,898 B1 4/2006 Baker
7,036,743 B2 5/2006 Shah
7,043,339 B2 5/2006 Maeda et al.
7,044,397 B2 5/2006 Bartlett et al.
7,047,092 B2 5/2006 Wimsatt
7,051,282 B2 5/2006 Marcjan
7,058,459 B2 6/2006 Weiberle et al.
7,058,477 B1 6/2006 Rosen
7,058,693 B1 6/2006 Baker, Jr.
7,058,737 B2 6/2006 Ellerbrock et al.
7,062,927 B2 6/2006 Kwon et al.
7,068,612 B2 6/2006 Berkcan et al.
7,076,962 B2 7/2006 He et al.
7,082,339 B2 7/2006 Murray et al.
7,082,352 B2 7/2006 Lim
7,083,109 B2 8/2006 Pouchak
7,085,626 B2 8/2006 Harrod et al.
7,089,087 B2 8/2006 Dudley
7,089,088 B2 8/2006 Terry et al.
7,092,772 B2 8/2006 Murray et al.
7,092,794 B1 8/2006 Hill et al.
7,096,078 B2 8/2006 Burr et al.
7,096,285 B2 8/2006 Ellerbrock et al.
7,099,965 B2 8/2006 Ellerbrock et al.
7,100,382 B2 9/2006 Butler et al.
7,103,000 B1 9/2006 Rode et al.
7,103,016 B1 9/2006 Duffy et al.
7,103,420 B2 9/2006 Brown et al.
7,110,835 B2 9/2006 Blevins et al.
7,114,088 B2 9/2006 Horbelt
7,114,554 B2 10/2006 Bergman et al.
7,117,050 B2 10/2006 Sasaki et al.
7,117,051 B2 10/2006 Landry et al.
7,117,395 B2 10/2006 Opaterny
7,120,036 B2 10/2006 Kyono
7,123,428 B2 10/2006 Yeo et al.
7,123,774 B2 10/2006 Dhavala et al.
7,127,305 B1 10/2006 Palmon
7,130,409 B2 10/2006 Beyda
7,130,719 B2 10/2006 Ehlers et al.
7,133,407 B2 11/2006 Jinzaki et al.
7,133,748 B2 11/2006 Robinson
7,133,749 B2 11/2006 Goldberg et al.
7,135,982 B2 11/2006 Lee
7,139,550 B2 11/2006 Cuellar et al.
7,146,230 B2 12/2006 Glanzer et al.
7,146,231 B2 12/2006 Schleiss et al.
7,146,253 B2 12/2006 Hoog et al.
7,150,408 B2 12/2006 DeLuca
7,155,318 B2 12/2006 Sharma et al.
7,155,499 B2 12/2006 Soemo et al.
7,156,316 B2 1/2007 Kates
7,162,512 B1 1/2007 Amit et al.
7,162,883 B2 1/2007 Jayanth et al.
7,163,156 B2 1/2007 Kates
7,163,158 B2 1/2007 Rossi et al.
7,167,762 B2 1/2007 Glanzer et al.
7,168,627 B2 1/2007 Kates
7,171,579 B2 1/2007 Weigl et al.
7,172,132 B2 2/2007 Proffitt et al.
7,174,239 B2 2/2007 Butler et al.
7,174,728 B2 2/2007 Jayanth
7,175,086 B2 2/2007 Gascoyne et al.
7,175,098 B2 2/2007 DeLuca
7,177,926 B2 2/2007 Kramer
7,181,317 B2 2/2007 Amundson et al.
7,185,262 B2 2/2007 Barthel et al.
7,186,290 B2 3/2007 Sheehan et al.
7,187,354 B2 3/2007 Min et al.
7,187,986 B2 3/2007 Johnson et al.
7,188,002 B2 3/2007 Chapman, Jr. et al.
7,188,207 B2 3/2007 Mitter
7,188,482 B2 3/2007 Sadegh et al.
7,188,779 B2 3/2007 Alles
7,191,028 B2 3/2007 Nomura et al.
7,194,663 B2 3/2007 Fletcher et al.
7,195,211 B2 3/2007 Kande et al.
7,197,717 B2 3/2007 Anderson et al.
7,200,450 B2 4/2007 Boyer et al.
7,203,165 B1 4/2007 Kowalewski
7,203,575 B2 4/2007 Maturana et al.
7,203,776 B2 4/2007 Junger et al.
7,206,646 B2 4/2007 Nixon et al.
7,206,647 B2 4/2007 Kumar
7,209,485 B2 4/2007 Guse
7,209,748 B2 4/2007 Wong et al.
7,212,825 B2 5/2007 Wong et al.
7,213,044 B2 5/2007 Tjong et al.

7,216,016 B2 5/2007 Van Ostrand et al.
7,216,017 B2 5/2007 Kwon et al.
7,216,497 B2 5/2007 Hull et al.
7,218,589 B2 5/2007 Wisnudel et al.
7,218,996 B1 5/2007 Beitelmal et al.
7,219,141 B2 5/2007 Bonasia et al.
7,222,152 B1 5/2007 Thompson et al.
7,222,493 B2 5/2007 Jayanth et al.
7,222,494 B2 5/2007 Peterson et al.
7,224,366 B2 5/2007 Kessler et al.
7,225,054 B2 5/2007 Amundson et al.
7,225,356 B2 5/2007 Monitzer
7,228,187 B2 6/2007 Ticky et al.
7,232,058 B2 6/2007 Lee
7,233,229 B2 6/2007 Stroupe et al.
7,239,623 B2 7/2007 Burghardt et al.
7,242,988 B1 7/2007 Hoffberg et al.
7,243,004 B2 7/2007 Shah et al.
7,244,294 B2 7/2007 Kates
7,246,753 B2 7/2007 Hull et al.
7,248,576 B2 7/2007 Hoffmann
7,251,534 B2 7/2007 Walls et al.
7,257,813 B1 8/2007 Mayer et al.
7,260,084 B2 8/2007 Saller
7,260,451 B2 8/2007 Takai et al.
7,260,609 B2 8/2007 Fuehrer et al.
7,260,948 B2 8/2007 Jayanth et al.
7,261,241 B2 8/2007 Eoga
7,261,243 B2 8/2007 Butler et al.
7,261,762 B2 8/2007 Kang et al.
7,266,775 B2 9/2007 Patitucci
7,266,960 B2 9/2007 Shah
7,269,962 B2 9/2007 Bachmann
7,272,154 B2 9/2007 Loebig
7,272,452 B2 9/2007 Coogan et al.
7,272,457 B2 9/2007 Glanzer et al.
7,274,972 B2 9/2007 Amundson et al.
7,274,973 B2 9/2007 Nichols et al.
7,277,280 B2 10/2007 Peng
7,277,970 B2 10/2007 Ellerbrock et al.
7,278,103 B1 10/2007 Clark et al.
7,287,062 B2 10/2007 Im et al.
7,287,708 B2 10/2007 Lucas et al.
7,287,709 B2 10/2007 Proffitt et al.
7,289,458 B2 10/2007 Gila et al.
7,292,900 B2 11/2007 Kreidler et al.
7,293,422 B2 11/2007 Parachini et al.
7,295,099 B2 11/2007 Lee et al.
7,296,426 B2 11/2007 Butler et al.
7,299,279 B2 11/2007 Sadaghiany
7,299,996 B2 11/2007 Garrett et al.
7,301,699 B2 11/2007 Kanamori et al.
7,305,495 B2 12/2007 Carter
7,306,165 B2 12/2007 Shah
7,310,559 B2 12/2007 Walko, Jr.
7,313,716 B2 12/2007 Weigl et al.
7,313,923 B2 1/2008 Jayanth et al.
7,315,768 B2 1/2008 Dang et al.
7,317,970 B2 1/2008 Pienta et al.
7,320,110 B2 1/2008 Shah
7,324,874 B2 1/2008 Jung
7,327,376 B2 2/2008 Shen et al.
7,327,815 B1 2/2008 Jurisch
7,330,512 B2 2/2008 Frank et al.
7,331,191 B2 2/2008 He et al.
7,334,161 B2 2/2008 Williams et al.
7,336,650 B2 2/2008 Franz et al.
7,337,369 B2 2/2008 Barthel et al.
7,337,619 B2 3/2008 Hsieh et al.
7,343,226 B2 3/2008 Ehlers et al.
7,346,404 B2 3/2008 Eryurek et al.
7,346,835 B1 3/2008 Lobinger et al.
7,349,761 B1 3/2008 Cruse
7,354,005 B2 4/2008 Carey et al.
7,356,050 B2 4/2008 Reindl et al.
7,359,345 B2 4/2008 Chang et al.
7,360,002 B2 4/2008 Brueckner et al.
7,360,370 B2 4/2008 Shah et al.
7,360,717 B2 4/2008 Shah
7,364,093 B2 4/2008 Garozzo
7,365,812 B2 4/2008 Lee
7,366,498 B2 4/2008 Ko et al.
7,366,944 B2 4/2008 Oshins et al.
7,370,074 B2 5/2008 Alexander et al.
7,377,450 B2 5/2008 Van Ostrand et al.
7,383,158 B2 6/2008 Krocker et al.
7,389,150 B2 6/2008 Inoue et al.
7,389,204 B2 6/2008 Eryurek et al.
RE40,437 E 7/2008 Rosen et al.
7,392,661 B2 7/2008 Alles
7,395,122 B2 7/2008 Kreidler et al.
7,395,137 B2 7/2008 Robinson
7,403,128 B2 7/2008 Scuka et al.
7,412,839 B2 8/2008 Jayanth
7,412,842 B2 8/2008 Pham
D578,026 S 10/2008 Roher et al.
7,433,740 B2 10/2008 Hesse et al.
7,434,744 B2 10/2008 Garozzo et al.
7,436,292 B2 10/2008 Rourke et al.
7,436,293 B2 10/2008 Rourke et al.
7,436,296 B2 10/2008 Rourke et al.
7,436,400 B2 10/2008 Cheng
7,437,198 B2 10/2008 Iwaki
7,441,094 B2 10/2008 Stephens
7,451,937 B2 11/2008 Flood et al.
7,454,269 B1 11/2008 Dushane et al.
7,455,240 B2 11/2008 Chapman, Jr. et al.
7,460,933 B2 12/2008 Chapman, Jr. et al.
8,078,326 B2 * 12/2011 Harrod et al. ..... 700/276
2001/0034586 A1 10/2001 Ewert et al.
2001/0048376 A1 12/2001 Maeda et al.
2002/0022894 A1 2/2002 Eryurek et al.
2002/0026476 A1 2/2002 Miyazaki et al.
2002/0072814 A1 6/2002 Schuler et al.
2002/0091784 A1 7/2002 Baker et al.
2002/0123896 A1 9/2002 Diez et al.
2002/0163427 A1 11/2002 Eryurek et al.
2002/0190242 A1 12/2002 Iillie et al.
2003/0058863 A1 3/2003 Oost
2003/0078677 A1 4/2003 Hull et al.
2003/0108064 A1 6/2003 Bilke et al.
2003/0115177 A1 6/2003 Takanabe et al.
2003/0229784 A1 12/2003 Cuellar et al.
2004/0039478 A1 2/2004 Kiesel et al.
2004/0095237 A1 5/2004 Chen et al.
2004/0104942 A1 6/2004 Weigel
2004/0107717 A1 6/2004 Yoon et al.
2004/0111186 A1 6/2004 Rossi et al.
2004/0117330 A1 6/2004 Ehlers et al.
2004/0139038 A1 7/2004 Ehlers et al.
2004/0143360 A1 7/2004 Kiesel et al.
2004/0146008 A1 7/2004 Conradt et al.
2004/0156360 A1 8/2004 Sexton et al.
2004/0159112 A1 8/2004 Jayanth et al.
2004/0189590 A1 9/2004 Mehaffey et al.
2004/0204775 A1 10/2004 Keyes et al.
2004/0205781 A1 10/2004 Hill et al.
2004/0206096 A1 10/2004 Jayanth
2004/0210348 A1 10/2004 Imhof et al.
2004/0218591 A1 11/2004 Ogawa et al.
2004/0236471 A1 11/2004 Poth
2004/0266491 A1 12/2004 Howard et al.
2004/0267385 A1 * 12/2004 Lingemann ..... 700/83
2004/0267790 A1 12/2004 Pak et al.
2005/0005249 A1 1/2005 Hill et al.
2005/0007249 A1 1/2005 Eryurek et al.
2005/0010759 A1 1/2005 Wakiyama
2005/0033707 A1 2/2005 Ehlers et al.
2005/0034023 A1 2/2005 Maturana et al.
2005/0041633 A1 2/2005 Roeser et al.
2005/0054381 A1 3/2005 Lee et al.
2005/0055427 A1 3/2005 Frutiger et al.
2005/0068978 A1 3/2005 Sexton et al.
2005/0076150 A1 4/2005 Lee et al.
2005/0080879 A1 4/2005 Kim et al.
2005/0081156 A1 4/2005 Clark et al.
2005/0081157 A1 4/2005 Clark et al.
2005/0096872 A1 5/2005 Blevins et al.

2005/0109048 A1 5/2005 Lee
2005/0116023 A1 6/2005 Amundson et al.
2005/0118996 A1 6/2005 Lee et al.
2005/0119766 A1 6/2005 Amundson et al.
2005/0120012 A1 6/2005 Poth et al.
2005/0125495 A1 6/2005 Tjong et al.
2005/0143138 A1 6/2005 Lee et al.
2005/0145705 A1 7/2005 Shah et al.
2005/0150967 A1 7/2005 Chapman, Jr. et al.
2005/0161517 A1 7/2005 Helt et al.
2005/0166610 A1 8/2005 Jayanth
2005/0176410 A1 8/2005 Brooking et al.
2005/0193155 A1 9/2005 Fujita
2005/0223339 A1 10/2005 Lee
2005/0229610 A1 10/2005 Park et al.
2005/0235661 A1 10/2005 Pham
2005/0235662 A1 10/2005 Pham
2005/0235663 A1 10/2005 Pham
2005/0258257 A1 11/2005 Thurman, Jr. et al.
2005/0270151 A1 12/2005 Winick
2005/0278071 A1 12/2005 Durham, III
2005/0280364 A1 12/2005 Omura et al.
2005/0281368 A1 12/2005 Droba et al.
2005/0288823 A1 12/2005 Hesse et al.
2006/0006244 A1 1/2006 Morrow, V et al.
2006/0021358 A1 2/2006 Nallapa
2006/0021359 A1 2/2006 Hur et al.
2006/0030954 A1 2/2006 Bergman et al.
2006/0041898 A1 2/2006 Potyrailo et al.
2006/0048064 A1 3/2006 Vronay
2006/0058924 A1 3/2006 Shah
2006/0090142 A1 4/2006 Glasgow et al.
2006/0090483 A1 5/2006 Kim et al.
2006/0091227 A1 5/2006 Attridge, Jr.
2006/0092977 A1 5/2006 Bai et al.
2006/0106791 A1 5/2006 Morrow et al.
2006/0108432 A1 5/2006 Mattheis
2006/0111816 A1 5/2006 Spalink et al.
2006/0130497 A1 6/2006 Kang et al.
2006/0144055 A1 7/2006 Ahn
2006/0144232 A1 7/2006 Kang et al.
2006/0149414 A1 7/2006 Archacki, Jr. et al.
2006/0150027 A1 7/2006 Paden
2006/0153247 A1 7/2006 Stumer
2006/0155398 A1 7/2006 Hoffberg et al.
2006/0158051 A1 7/2006 Bartlett et al.
2006/0159007 A1 7/2006 Frutiger et al.
2006/0168522 A1 7/2006 Bala
2006/0186214 A1 8/2006 Simon et al.
2006/0190138 A1 8/2006 Stone et al.
2006/0192021 A1 8/2006 Schultz et al.
2006/0196953 A1 9/2006 Simon et al.
2006/0200253 A1 9/2006 Hoffberg et al.
2006/0200258 A1 9/2006 Hoffberg et al.
2006/0200259 A1 9/2006 Hoffberg et al.
2006/0200260 A1 9/2006 Hoffberg et al.
2006/0202978 A1 9/2006 Lee et al.
2006/0206220 A1 9/2006 Amundson
2006/0209208 A1 9/2006 Kim et al.
2006/0219799 A1 10/2006 Schultz et al.
2006/0229090 A1 10/2006 LaDue
2006/0235548 A1 10/2006 Gaudette
2006/0236351 A1 10/2006 Ellerbrock et al.
2006/0239296 A1 10/2006 Jinzaki et al.
2006/0248233 A1 11/2006 Park et al.
2006/0276917 A1 12/2006 Li et al.
2007/0005191 A1 1/2007 Sloup et al.
2007/0008116 A1 1/2007 Bergman et al.
2007/0012052 A1 1/2007 Butler et al.
2007/0013534 A1 1/2007 DiMaggio
2007/0014233 A1 1/2007 Oguro et al.
2007/0016311 A1 1/2007 Bergman et al.
2007/0016476 A1 1/2007 Hoffberg et al.
2007/0025368 A1 2/2007 Ha et al.
2007/0032909 A1 2/2007 Tolbert, Jr. et al.
2007/0033310 A1 2/2007 Kweon
2007/0040040 A1 2/2007 Mueller
2007/0043478 A1 2/2007 Ehlers et al.
2007/0045429 A1 3/2007 Chapman, Jr. et al.
2007/0045431 A1 3/2007 Chapman, Jr. et al.
2007/0045442 A1 3/2007 Chapman, Jr. et al.
2007/0051818 A1 3/2007 Atlas
2007/0055407 A1 3/2007 Goldberg et al.
2007/0067496 A1 3/2007 Deiretsbacher et al.
2007/0073973 A1 3/2007 Hazay
2007/0080235 A1 4/2007 Fulton, Jr.
2007/0083721 A1 4/2007 Grinspan
2007/0084937 A1 4/2007 Ahmed
2007/0088883 A1 4/2007 Wakabayashi
2007/0089090 A1 4/2007 Riedl et al.
2007/0090199 A1 4/2007 Hull et al.
2007/0093226 A1 4/2007 Foltyn et al.
2007/0102149 A1 5/2007 Kates
2007/0109975 A1 5/2007 Reckamp et al.
2007/0113247 A1 5/2007 Kwak
2007/0114291 A1* 5/2007 Pouchak ..... 236/44 C
2007/0119957 A1 5/2007 Kates
2007/0119958 A1 5/2007 Kates
2007/0129820 A1 6/2007 Glanzer et al.
2007/0129825 A1 6/2007 Kargenian
2007/0129826 A1 6/2007 Kreidler et al.
2007/0129917 A1 6/2007 Blevins et al.
2007/0130834 A1 6/2007 Kande et al.
2007/0130969 A1 6/2007 Peterson et al.
2007/0135692 A1 6/2007 Hwang et al.
2007/0135946 A1 6/2007 Sugiyama et al.
2007/0136669 A1 6/2007 Kwon et al.
2007/0136687 A1 6/2007 Pak
2007/0138307 A1 6/2007 Khoo
2007/0138308 A1 6/2007 Schultz et al.
2007/0143704 A1 6/2007 Laird-McConnell
2007/0143707 A1 6/2007 Yun et al.
2007/0158442 A1 7/2007 Chapman, Jr. et al.
2007/0168887 A1 7/2007 Lee
2007/0177505 A1 8/2007 Charrua et al.
2007/0191024 A1 8/2007 Kim et al.
2007/0192731 A1 8/2007 Townsend et al.
2007/0204637 A1 9/2007 Fujii et al.
2007/0205297 A1 9/2007 Finkam et al.
2007/0208461 A1 9/2007 Chase
2007/0208549 A1 9/2007 Blevins et al.
2007/0213853 A1 9/2007 Glanzer et al.
2007/0223500 A1 9/2007 Lee et al.
2007/0225868 A1 9/2007 Terlson et al.
2007/0225869 A1 9/2007 Amundson et al.
2007/0237032 A1 10/2007 Rhee et al.
2007/0238413 A1 10/2007 Coutts
2007/0239658 A1 10/2007 Cunningham et al.
2007/0240226 A1 10/2007 Song et al.
2007/0241203 A1 10/2007 Wagner et al.
2007/0242058 A1 10/2007 Yamada
2007/0245306 A1 10/2007 Dameshek et al.
2007/0257120 A1 11/2007 Chapman, Jr. et al.
2007/0260978 A1 11/2007 Oh et al.
2007/0266329 A1 11/2007 Gaudette
2007/0271521 A1 11/2007 Harriger et al.
2007/0274093 A1 11/2007 Haim et al.
2007/0277013 A1 11/2007 Rexha et al.
2007/0278320 A1 12/2007 Lunacek et al.
2007/0284452 A1 12/2007 Butler et al.
2007/0299857 A1 12/2007 Gwozdz et al.
2007/0300064 A1 12/2007 Isaacs et al.
2008/0004727 A1 1/2008 Glanzer et al.
2008/0005428 A1 1/2008 Maul et al.
2008/0006709 A1 1/2008 Ashworth et al.
2008/0031147 A1 2/2008 Fieremans et al.
2008/0040351 A1 2/2008 Jin et al.
2008/0048045 A1 2/2008 Butler et al.
2008/0054082 A1 3/2008 Evans et al.
2008/0055190 A1 3/2008 Lee
2008/0057872 A1 3/2008 McFarland et al.
2008/0059682 A1 3/2008 Cooley et al.
2008/0062892 A1 3/2008 Dodgen et al.
2008/0063006 A1 3/2008 Nichols
2008/0065926 A1 3/2008 Poth et al.
2008/0072704 A1 3/2008 Clark et al.
2008/0073440 A1 3/2008 Butler et al.
2008/0077884 A1 3/2008 Patitucci

| | | | | |
|---|---|---|---|---|
| 2008/0077886 | A1 | 3/2008 | Eichner | |
| 2008/0083009 | A1 | 4/2008 | Kaler et al. | |
| 2008/0097651 | A1 | 4/2008 | Shah et al. | |
| 2008/0099568 | A1* | 5/2008 | Nicodem et al. | 236/51 |
| 2008/0104189 | A1 | 5/2008 | Baker et al. | |
| 2008/0114500 | A1 | 5/2008 | Hull et al. | |
| 2008/0128523 | A1 | 6/2008 | Hoglund et al. | |
| 2008/0133033 | A1 | 6/2008 | Wolff et al. | |
| 2008/0133060 | A1 | 6/2008 | Hoglund et al. | |
| 2008/0133061 | A1 | 6/2008 | Hoglund et al. | |
| 2008/0134087 | A1 | 6/2008 | Hoglund et al. | |
| 2008/0134098 | A1 | 6/2008 | Hoglund et al. | |
| 2008/0161977 | A1 | 7/2008 | Takach et al. | |
| 2008/0161978 | A1 | 7/2008 | Shah | |
| 2008/0168356 | A1 | 7/2008 | Eryurek et al. | |
| 2008/0183335 | A1 | 7/2008 | Poth et al. | |
| 2008/0185976 | A1 | 8/2008 | Dickey et al. | |
| 2008/0186160 | A1 | 8/2008 | Kim et al. | |
| 2008/0195254 | A1 | 8/2008 | Jung et al. | |
| 2008/0195687 | A1 | 8/2008 | Jung et al. | |
| 2008/0215987 | A1 | 9/2008 | Alexander et al. | |
| 2008/0217418 | A1 | 9/2008 | Helt et al. | |
| 2008/0223944 | A1* | 9/2008 | Helt et al. | 236/51 |
| 2008/0256475 | A1 | 10/2008 | Amundson et al. | |
| 2008/0264085 | A1 | 10/2008 | Perry et al. | |
| 2008/0294274 | A1 | 11/2008 | Laberge et al. | |
| 2008/0294932 | A1 | 11/2008 | Oshins et al. | |
| 2009/0001180 | A1 | 1/2009 | Siddaramanna et al. | |
| 2009/0001182 | A1 | 1/2009 | Siddaramanna et al. | |
| 2009/0049847 | A1 | 2/2009 | Butler et al. | |
| 2009/0261767 | A1* | 10/2009 | Butler et al. | 318/445 |
| 2010/0107076 | A1* | 4/2010 | Grohman et al. | 715/709 |

OTHER PUBLICATIONS

Related case U.S. Appl. No. 12/603,382, filed Oct. 21, 2009 to Wojciech Grohman, entitled "Device Abstraction System and Method for a Distributed-Architecture Heating, Ventilation and Air Conditioning System".

Related case U.S. Appl. No. 12/603,504, filed Oct. 21, 2009 to Wojciech Grohman, entitled "Device Abstraction System and Method for a Distributed-Architecture Heating, Ventilation and Air Conditioning System".

Related case U.S. Appl. No. 12/603,449, filed Oct. 21, 2009 to Amanda Filbeck et al., entitled "System and Method of Use for a User Interface Dashboard of a Heating, Ventilation and Air Conditioning Network".

Related case U.S. Appl. No. 12/603,460, filed Oct. 21, 2009 to Wojciech Grohman et al., entitled "System and Method of Use for a User Interface Dashboard of a Heating, Ventilation and Air Conditioning Network".

Related case U.S. Appl. No. 12/603,526, filed Oct. 21, 2009 to Wojciech Grohman et al., entitled "Communication Protocol System and Methof for a Distributed-Architecture Heating, Ventilation and Air Conditioning Network".

Related case U.S. Appl. No. 12/603,532, filed Oct. 21, 2009 to Wojciech Grohman, entitled "Communication Protocol System and Method for a Distributed-Architecture Heating, Ventilation and Air Conditioning Network".

Related case U.S. Appl. No. 12/603,475, filed Oct. 21, 2009 to Suresh Kumar Devineni et al., entitled "System and Method of Use for a User Interface Dashboard of a Heating, Ventilation and Air Conditioning Network".

Related case U.S. Appl. No. 12/603,362, filed Oct. 21, 2009 to Wojciech Grohman et al., entitled "Device Abstraction System and Method for a Distributed-Architecture Heating, Ventilation and Air Conditioning System".

Related case U.S. Appl. No. 12/603,473, filed Oct. 21, 2009 to Wojciech Grohman et al., entitled "System and Method for Zoning a Distributed-Architecture Heating, Ventilation and Air Conditioning Network".

Related case U.S. Appl. No. 12/603,407, filed Oct. 21, 2009 to Amanda Filbeck et al., entitled "System and Method for Zoning a Distributed-Architecture Heating, Ventilation and Air Conditioning Network".

Related case U.S. Appl. No. 12/603,496, filed Oct. 21, 2009 to Wojciech Grohman et al., entitled "Device Abstraction System and Method for a Distributed-Architecture Heating, Ventilation and Air Conditioning System".

Related case U.S. Appl. No. 12/603,482, filed Oct. 21, 2009 to Muhammad Mirza et al., entitled "System and Method of Use for a User Interface Dashboard of a Heating, Ventilation and Air Conditioning Network".

Related case U.S. Appl. No. 12/603,488, filed Oct. 21, 2009 to Muhammad Mirza et al., entitled "System and Method of Use for a User Interface Dashboard of a Heating, Ventilation and Air Conditioning Network".

Related case U.S. Appl. No. 12/603,495, filed Oct. 21, 2009 to Thomas Pavlak et al., entitled "System and Method of Use for a User Interface Dashboard of a Heating, Ventilation and Air Conditioning Network".

Related case U.S. Appl. No. 12/603,497, filed Oct. 21, 2009 to Muhammad Mirza et al., entitled "System and Method of Use for a User Interface Dashboard of a Heating, Ventilation and Air Conditioning Network".

Related case U.S. Appl. No. 12/603,497, filed Oct. 21, 2009 to Wojciech Grohman et al., entitled "General Control Technique in a Heating, Ventilation and Air Conditioning Network".

Related case U.S. Appl. No. 12/603,502, filed Oct. 21, 2009 to Jacob Jennings et al., entitled "System and Method of Use for a User Interface Dashboard of a Heating, Ventilation and Air Conditioning Network".

Related case U.S. Appl. No. 12/603,489, filed Oct. 21, 2009 to Wojciech Grohman et al., entitled "System and Method for Zoning a Distributed-Architecture Heating, Ventilation and Air Conditioning Network".

Related case U.S. Appl. No. 12/603,527, filed Oct. 21, 2009 to Darko Hadzidedic, entitled "Memory Recovery Scheme and Data Structure in a Heating, Ventilation and Air Conditioning Network".

Related case U.S. Appl. No. 12/603,479, filed Oct. 21, 2009 to Wojciech Grohman et al., entitled "Device Abstraction System and Method for a Distributed-Architecture Heating, Ventilation and Air Conditioning System".

Related case U.S. Appl. No. 12/603,536, filed Oct. 21, 2009 to Timothy Wallaert et al., entitled "Communication Protocol System and Method for a Distributed-Architecture Heating, Ventilation and Air Conditioning Network".

Related case U.S. Appl. No. 12/603,509, filed Oct. 21, 2009 to Timothy Wallaert et al., entitled "System and Method of Use for a User Interface Dashboard of a Heating, Ventilation and Air Conditioning Network".

Related case U.S. Appl. No. 12/603,512, filed Oct. 21, 2009 to Wojciech Grohman et al., entitled "Programming and Configuration in a Heating, Ventilation and Air Conditioning Network".

Related case U.S. Appl. No. 12/603,464, filed Oct. 21, 2009 to Wojciech Grohman et al., entitled "Alarm and Diagnostics System and Method for a Distributed-Architecture Heating, Ventilation and Air Conditioning Network".

Related case U.S. Appl. No. 12/603,528, filed Oct. 21, 2009 to Wojciech Grohman et al., entitled "Memory Recovery Scheme and Data Structure in a Heating, Ventilation and Air Conditioning Network".

Related case U.S. Appl. No. 12/603,525, filed Oct. 21, 2009 to Wojciech Grohman et al., entitled "Method of Controlling Equipment in a Heating, Ventilation and Air Conditioning Network".

Related case U.S. Appl. No. 12/603,520, filed Oct. 21, 2009 to Darko Hadzidedic et al., entitled "Alarm and Diagnostics System and Method for a Distributed-Architecture Heating, Ventilation and Air Conditioning Network".

Related case U.S. Appl. No. 12/603,539, filed Oct. 21, 2009 to Wojciech Grohman et al., entitled "Communication Protocol System and Method for a Distributed-Architecture Heating, Ventilation and Air Conditioning Network".

Related case U.S. Appl. No. 12/603,420, filed Oct. 21, 2009 to Darko Hadzidedic et al., entitled "Alarm and Diagnostics System and Method for a Distributed-Architecture Heating, Ventilation and Air Conditioning Network".

Related case U.S. Appl. No. 12/603,483, filed Oct. 21, 2009 to Wojciech Grohman et al., entitled "Device Abstraction System and Method for a Distributed-Architecture Heating, Ventilation and Air Conditioning System".
Related case U.S. Appl. No. 12/603,514, filed Oct. 21, 2009 to Thomas Pavlak et al., entitled "System and Method of Use for a User Interface Dashboard of a Heating, Ventilation and Air Conditioning Network".
Related case U.S. Appl. No. 12/603,515, filed Oct. 21, 2009 to Wojciech Grohman et al., entitled "Alarm and Diagnostics System and Method for a Distributed-Architecture Heating, Ventilation and Air Conditioning Network".
Related case U.S. Appl. No. 12/603,490, filed Oct. 21, 2009 to Wojciech Grohman, entitled "System Recovery in a Heating, Ventilation and Air Conditioning Network".
Related case U.S. Appl. No. 12/603,523, filed Oct. 21, 2009 to Wojciech Grohman et al., entitled "Alarm and Diagnostics System and Method for a Distributed-Architecture Heating, Ventilation and Air Conditioning".
Related case U.S. Appl. No. 12/603,493, filed Oct. 21, 2009 to Wojciech Grohman et al., entitled "System Recovery in a Heating, Ventilation and Air Conditioning Network".
Related case U.S. Appl. No. 12/603,547, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,531, filed Oct. 21, 2009 to Wojciech Grohman, entitled "Memory Recovery Scheme and Data Structure in a Heating, Ventilation and Air Conditioning Network".
Related case U.S. Appl. No. 12/603,555, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,562, filed Oct. 21, 2009 to Wojciech Grohman et al., entitled "Communication Protocol System and Method for a Distributed-Architecture Heating, Ventilation and Air Conditioning Network".
Related case U.S. Appl. No. 12/603,566, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,451, filed Oct. 21, 2009 to Timothy Wallaert, entitled "Alarm and Diagnostics System and Method for a Distributed-Architecture Heating, Ventilation and Air Conditioning Network".
Related case U.S. Appl. No. 12/603,553, filed Oct. 21, 2009 to Wojciech Grohman et al., entitled "Communication Protocol System and Method for a Distributed-Architecture Heating, Ventilation and Air Conditioning Network".
Related case U.S. Appl. No. 12/603,487, filed Oct. 21, 2009 to Wojciech Grohman, entitled "System Recovery in a Heating, Ventilation and Air Conditioning Network".
Related case U.S. Appl. No. 12/603,558, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,468, filed Oct. 21, 2009 to Wojciech Grohman et al., entitled "Programming and Configuration in a Heating, Ventilation and Air Conditioning Network".
Related case U.S. Appl. No. 12/603,560, filed Oct. 21, 2009 to Wojciech Grohman, entitled "Communication Protocol System and Method for a Distributed-Architecture Heating, Ventilation and Air Conditioning Network".
Related case U.S. Appl. No. 12/603,519, filed Oct. 21, 2009 to Thomas Pavlak, entitled "System and Method of Use for a User Interface Dashboard of a Heating, Ventilation and Air Conditioning Network".
Related case U.S. Appl. No. 12/603,499, filed Oct. 21, 2009 to Jimmy Curry et al., entitled "Alarm and Diagnostics System and Method for a Distributed-Architechture Heating, Ventilation and Air Conditioning Network".
Related case U.S. Appl. No. 12/603,534, filed Oct. 21, 2009 to Timothy Wallaert et al., entitled "Flush Wall Mount Thermostat and In-Set Mounting Plate for a Heating, Ventilation and Air Conditioning System".
Related case U.S. Appl. No. 29/345,748, filed Oct. 21, 2009 to Timothy Wallaert et al., entitled "Thin Cover Plate for an Electronic System Controller".
Related case U.S. Appl. No. 29/345,747, filed Oct. 21, 2009 to Timothy Wallaert et al., entitled "Thin Cover Plate for an Electronic System Controller".
Related case U.S. Appl. No. 12/603,508, filed Oct. 21, 2009 to Wojciech Grohman, entitled "Alarm and Diagnostics System and Method for a Distributed-Architecture Heating, Ventilation and Air Conditioning Network ".

* cited by examiner

AUXILIARY CONTROLLER OF A HVAC SYSTEM

TECHNICAL FIELD

This application is directed, in general, to heating, ventilating and air conditioning (HVAC) systems and, more specifically, to maintaining model specific information or identification data for a main system controller of an HVAC system.

BACKGROUND

HVAC systems can be used to regulate the environment within an enclosure. Typically, an air blower is used to pull air from the enclosure into the HVAC system through ducts and push the air back into the enclosure through additional ducts after conditioning the air (e.g., heating or cooling the air). In HVAC systems, whether a furnace or a coil blower unit, a single integrated electronic controller may be used to direct the operation.

The integrated electronic controllers of the HVAC systems may be used in different HVAC systems of varying sizes and may be used with various brands of products. As such, an electronic controller may require different feature sets depending on the HVAC system in which the integrated electronic controllers are used. As such, different feature sets can be loaded on an electronic controller for a HVAC system that are tailored for the specific HVAC system and/or installation of the specific HVAC system. To provide the proper feature sets for an electronic controller for a specific HVAC system or application, a manufacturer of the HVAC system may load model identification data and/or model specific information on the electronic controller.

SUMMARY

The disclosure provides, in one aspect, an auxiliary controller of a HVAC system. In one embodiment, the auxiliary controller includes: (1) an interface coupled to a main system controller of the HVAC system and configured to communicate therewith, the main system controller having main controller application information stored thereon, (2) a processor, coupled to the interface and configured to direct the operation of an auxiliary component of the HVAC system and (3) a non-volatile memory configured to receive a copy of the main controller application information via the interface and store the main controller application information thereon.

In another aspect, a method of starting a HVAC system is disclosed. In one embodiment, the method includes: (1) receiving an initiation signal at a main system controller of the HVAC system, (2) determining if main controller application information associated with the main system controller is stored thereon, (3) querying an auxiliary controller of the HVAC system when determining the main controller application information is not stored on the main system controller, (4) sending the main controller application information to the main system controller from the auxiliary controller when the auxiliary controller includes the main controller application information and (5) initiating the HVAC system based on the initiation signal and employing the main controller application information sent to the main system controller from the auxiliary controller.

In yet another aspect, a method of manufacturing a HVAC system is disclosed. In one embodiment, the method of manufacturing includes: (1) storing main controller application information for a main system controller of the HVAC system in the main system controller during manufacturing of the HVAC system and (2) storing a copy of the main controller application information in an auxiliary controller of the main system controller during the manufacturing.

In still another aspect, a HVAC system is disclosed. In one embodiment, the HVAC system includes: (1) a main system controller having a main non-volatile memory and configured to direct operation of the HVAC system and store main controller application information associated therewith on the main non-volatile memory (2) an auxiliary controller having (2A) an interface coupled to the main system controller and configured to communicate therewith, (2B) a processor, coupled to the interface and configured to direct the operation of a component of the HVAC system and (2C) an auxiliary non-volatile memory configured to receive a copy of the main controller application information via the interface and store the main controller application information thereon.

In an additional aspect, an integrated controller for a HVAC system is disclosed. In one embodiment, the integrated controller includes: (1) an interface coupled to an auxiliary controller of the HVAC system and configured to communicate therewith, the auxiliary controller having an auxiliary non-volatile memory, (2) a processor, coupled to the interface and configured to direct the operation of the HVAC system and (3) a main non-volatile memory coupled to the processor and configured to receive a copy of main controller application information associated with the main system controller via the interface and store the main controller application information, the processor further configured to automatically send a copy of the main controller application information during manufacturing of the HVAC system to the auxiliary controller of the HVAC system to store as back-up data on the auxiliary non-volatile memory of the auxiliary controller.

BRIEF DESCRIPTION

Reference is now made to the following descriptions taken in conjunction with the accompanying drawings, in which.

DETAILED DESCRIPTION

Figure 1:
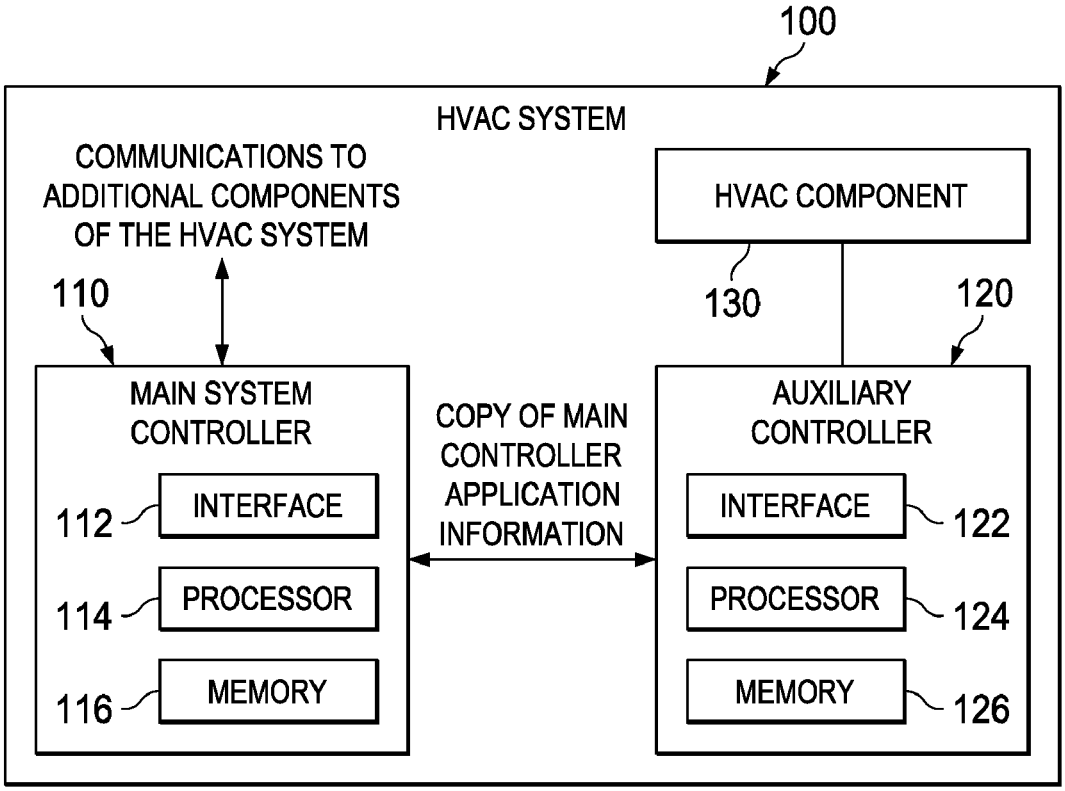
FIG. 1 is a block diagram of an embodiment of a HVAC system constructed according to the principles of the disclosure.

An Original Equipment Manufacturer (OEM) can load the associated model information or model identification data on the main integrated electronic controller of an HVAC system eliminate the need for additional external hardware that could be required to identify the controller. As such, the cost of construction can be decreased and the ability for standardization can be improved. A negative outcome, however, of storing unit specific information on the main integrated electronic (i.e., main system controller) may be evident during failure and ultimate replacement of the main system controller. In this case, after installing the new controller, the installer or technician can experience an error code upon initial start-up due to missing unit information which will require additional action by the installer to manually select the unit ID. The additional action required by the technician can delay starting an out-of-service HVAC system. Additionally, by relying on the technician to enter the proper model information for the controller, the technician may incorrectly enter the model information. As such, the proper feature set or sets for the main system controller may not be loaded. This may result in improper operation and additional failures of the HVAC system.

Accordingly, the present disclosure provides a copy of main controller application information associated with the main system controller of a HVAC system in at least one auxiliary controller of the HVAC system. The main controller application information is data for the main system controller. The associated data may include model specific information, model identification data, application information for the HVAC system (i.e., information associated with a specific installation of the HVAC system), and feature sets for the HVAC system (general for the HVAC system or specific for the application). By providing a back-up copy of the main controller application information, upon initial power up of a replacement main system controller or a corrupted main system controller, the new or corrupted main controller will realize the model ID or model specific information is not available and will query a controller of an auxiliary component to determine if the needed information is stored thereon. For example, an auxiliary component may be an indoor blower motor and the auxiliary controller a motor controller for the indoor blower motor. If the information is found in the auxiliary controller, then it is sent to the main system controller memory and the operation of the HVAC system can proceed as normal. No error code needs to be displayed and no manual intervention is required by the technician. The specification, therefore, provides embodiments that provide a back-up for the main controller application information and eliminate the need for additional external hardware. As such, the cost of construction can be decreased, the ability for standardization can be improved and the robustness of the system improved.

Typically, each HVAC system will include a designated controller, a main system controller, which is configured to direct the overall operation thereof. As such, the main system controllers disclosed herein are configured to provide control functionality beyond the scope of the present disclosure. The main system controllers may be one or more electric circuit boards including at least one micro-processor or micro-controller integrated circuit. The main system controllers also include the support circuitry for power, signal conditioning, and associated peripheral devices. In addition to a processor, the main system controllers may include a memory having a program or series of operating instruction (i.e., firmware or software) that executes in such a way as to implement at least some of the features described herein when initiated by the processor. The memory includes a non-volatile memory. The auxiliary controllers may be similarly configured and also include a non-volatile memory.

The main controller application information may be copied from the main system controller to the auxiliary controller during manufacturing of the HVAC system. The main controller application information may be automatically copied when the main system controller is loaded with the controller application information. The auxiliary controller may be predetermined. In some embodiments, the auxiliary controller may be a designated auxiliary controller for each type of HVAC system. In some embodiments, the auxiliary controller may vary and could be selected by, for example, a manufacturer.

FIG. 1 is a block diagram of an embodiment of a HVAC system 100 constructed according to the principles of the disclosure. The HVAC system 100 may be, for example, a furnace or a coil blower unit. The HVAC system 100 includes a main system controller 110, an auxiliary controller 120 and a HVAC component 130. In addition to the illustrated component 130, the HVAC system 100 includes additional components as may be typically included in a conventional HVAC system. For example, one skilled in the art will understand that the HVAC system 100 may include heating, cooling and blower (HCB) components that are typically included in a HVAC unit. The additional HCB components are not presently illustrated or discussed but are typically included in an HVAC unit, such as, a compressor, an indoor air blower, an outdoor fan and an electrical heating element. Typical components may also include a power supply, a temperature sensor, etc. The various components of the HVAC system 100 may be contained within a single enclosure (e.g., a cabinet).

The main system controller 110 is configured to direct the operation of the various HCB components. The main system controller 110 includes a communications interface 112, a processor 114 and a memory 116. The communications interface 112 is configured to communicate with the various components of the HVAC system 100. The processor 114 is configured to direct operation of the various components via the communications interface 112. The memory 110 is configured to store a series of operating instructions that direct the operation of the processor 114 when initiated thereby. The memory 116 is non-volatile memory or at least includes a portion that is non-volatile. The memory 116 also includes main controller application information for the main system controller 110. The main controller application information may be loaded in the memory 116 during manufacturing. In some embodiments, the main controller application information may be loaded during the final functional OEM testing of the HVAC system 100. In other embodiments, the main controller application information may be loaded during final functional testing of the main system controller 116 (e.g., a furnace controller). In one embodiment, the main system controller 116 may include information for applicable HVAC system models that was loaded during final functional testing of the main system controller. During final functional testing of the HVAC system 100, the applicable main controller application information that is used (or even an index of a table of the information that was used) may be stored in the memory 116.

A factory programmer (e.g., a computer) may be used to load the main controller application information on the memory 116 at the manufacturer via the interface 112. In some embodiments, the factory programmer may automatically load main controller application information after or as part of the functional testing. In addition to a factory programmer, other computing devices such as a portable computer (e.g., a laptop) or a portable memory device may be used to manually load the main controller application information to the memory 116. The portable memory device may be a "pen drive." As is widely known, a pen drive, also called a "memory stick" or a "jump drive," is a solid-state device containing non-volatile computer memory, typically flash random-access memory (RAM), and a Universal Serial Bus (USB) port that allows external access to the non-volatile memory.

The auxiliary controller 120 also includes an interface 122, a processor 124 and a memory 126. The memory 126 is a non-volatile memory or at least includes a portion that is non-volatile. The interface 122 is coupled to the main system controller 110 via the interface 112 and is configured to communicate therewith. The interface 122 is also coupled to the HVAC component 130 and configured to communicate therewith.

The interfaces 112, 122, may be conventional communication ports and may be coupled via a system bus. The system bus may be a typical bus that is employed in HVAC systems. The processor 124 is coupled to the interface 122 and is configured to direct the operation of the HVAC component 130. The memory 126 is configured to store a series of operating instructions that direct the operation of the processor 124 when initiated thereby. The memory 126 may also include various parameters associated with the HVAC component 130 that are employed to operate the HVAC component 130. In addition, the memory 126 is also configured to receive the main controller application information from the main system controller 110 via the interfaces 112, 122, and store the main controller application information in the non-volatile memory of the auxiliary controller 120. The main controller application information may be automatically copied to the non-volatile memory of the memory 126 at the manufacturer of the HVAC system 100. In some embodiments, the controller application information may be manually loaded on the auxiliary controller 120 via the interface 122 employing a computing or memory device.

Figure 2:
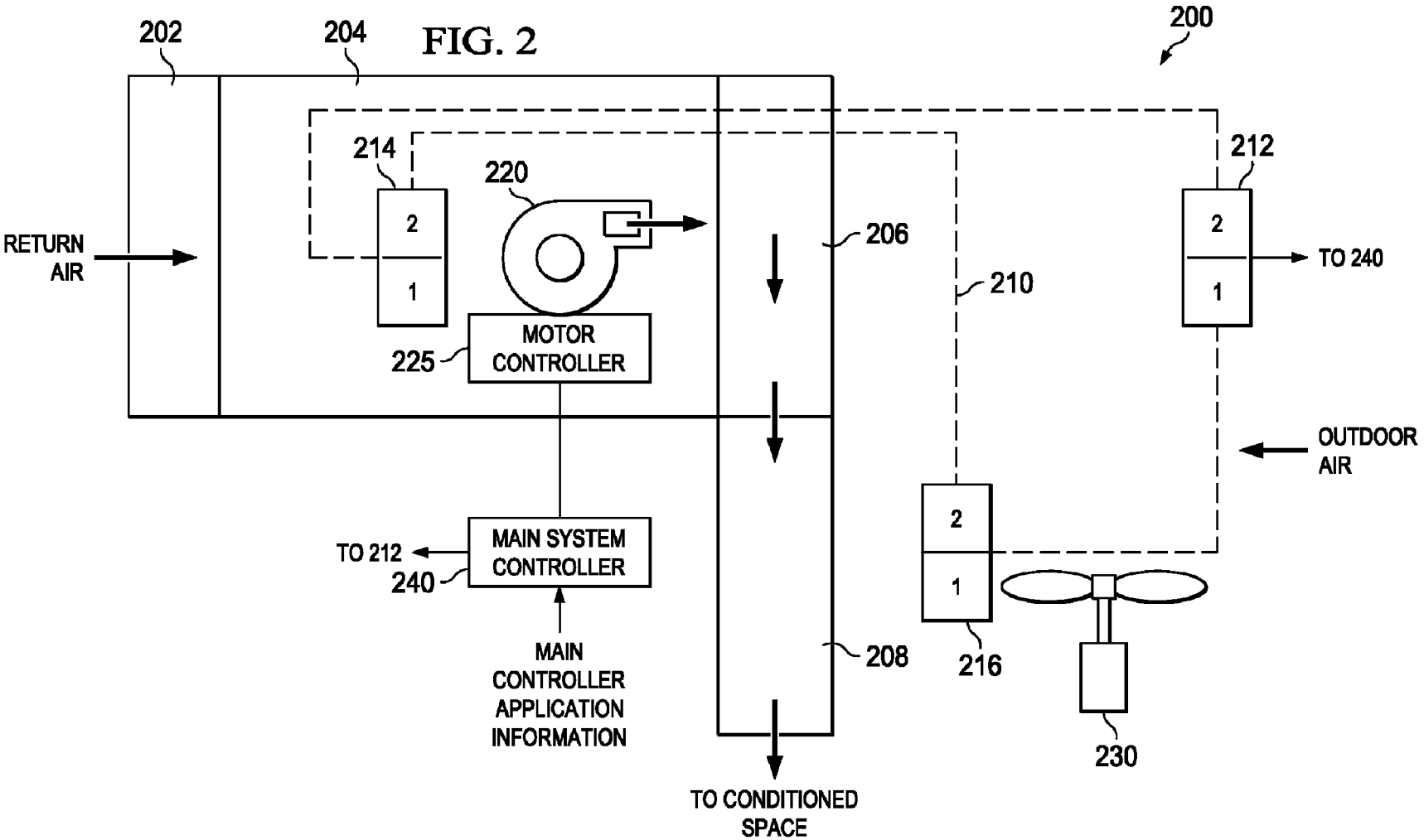
FIG. 2 is a system diagram of an embodiment of a HVAC system constructed according to the principles of the disclosure.

The HVAC component 130 may be an indoor blower motor for the HVAC system 100. In such an embodiment, the auxiliary controller 120 is an indoor blower motor controller. FIG. 2 provides an embodiment of an HVAC system wherein the auxiliary component is an indoor blower motor.

FIG. 2 is a system diagram of an embodiment of HVAC system 200 constructed according to the principles of the disclosure. The HVAC system 200 includes a return duct 202, a return plenum 204, a supply duct 206 and a supply plenum 208. Additionally, the HVAC system 200 may include a refrigeration circuit having a compressor system 212, evaporator coils 214 and condenser coils 216, an indoor air blower 220, a motor controller 225, an outdoor fan 230 and a main system controller 240. Each of the components of the refrigeration circuit 210 is fluidly coupled together. In this embodiment, the compressor system 212, the evaporator coils 214, and the condenser coils 216 each include two units as denoted by the numbers 1-2 in FIG. 2. The multiple units of the refrigeration system 210 represent two cooling stages of the HVAC system 200. One skilled in the art will understand that this disclosure also applies to other HVAC embodiments having a single cooling stage, more than two cooling stages or no cooling stages. For example, one skilled in the art will also understand that this disclosure and the main system controller applies to other HVAC systems such as a furnace.

One skilled in the art will also understand that the HVAC system 200 may include additional components and devices that are not presently illustrated or discussed but are typically included in an HVAC system, such as, a power supply, a temperature sensor, a humidity sensor, etc. A thermostat (not shown) is also typically employed with the HVAC system 200 and used as a user interface. The various illustrated components of the HVAC system 200 may be contained within a single enclosure (e.g., a cabinet). In one embodiment, the HVAC system 200 may be a rooftop unit.

The refrigeration circuit 210, the indoor air blower 220, the outdoor fan system 230 and the humidity sensor 240 may be conventional devices that are typically employed in HVAC systems. At least some of the operation of the HVAC system 200 can be controlled by the main system controller 240 based on inputs from various sensors of the HVAC system 200 including a temperature sensor or a humidity sensor. For example, the main system controller 240 can employ the motor controller 225 to cause the indoor air blower 220 to move air across the evaporator coils 214 and into an enclosed space.

The motor controller 225 includes an interface, a processor and a non-volatile memory that is used to store a copy of the main controller application information for the main system controller 240. The copy of the main controller application information may be used as a back-up if, for example, the controller application information on the main system controller 240 becomes corrupted. Additionally, the main controller application information stored on the motor controller 225 may be use when a new main system controller is installed. The new main system controller can query the motor controller 225 to determine if the main controller application information is stored thereon and obtain the main controller application information therefrom.

The main system controller 240 may include a processor, such as a microprocessor, configured to direct the operation of the HVAC system 200. Additionally, the main system controller 240 may include an interface and a memory section, having a non-volatile memory, coupled thereto. The interface and memory section may be configured to communicate (i.e., receive and transmit) and store main controller application information for the main system controller 240. The main controller application information for the main system controller 240 can include model specific information and model identification data. The model specific information may include feature sets that are applicable to the particular HVAC system 200. In addition to being uniquely tailored for the HVAC system 200, the main controller application information may also be uniquely tailored to an application of the HVAC system 200 for the customer.

The interfaces of the motor controller 225 and the main system controller 240 may include multiple ports for transmitting and receiving data. The ports may be conventional receptacles for communicating data via various means such as, a portable memory device, a PC or portable computer or a communications network. The interfaces are coupled to the memory sections of the controllers, which may be designed as a conventional memory that is constructed to store data and computer programs and include a non-volatile memory.

As illustrated in FIG. 2, the main system controller 240 is coupled to the various components of the HVAC system 200. In some embodiments, the connections therebetween are through a wired-connection. A conventional cable and contacts may be used to couple the main system controller 240 to the various components of the HVAC system 200. In other embodiments, a wireless connection may also be employed to provide at least some of the connections.

Figure 3:
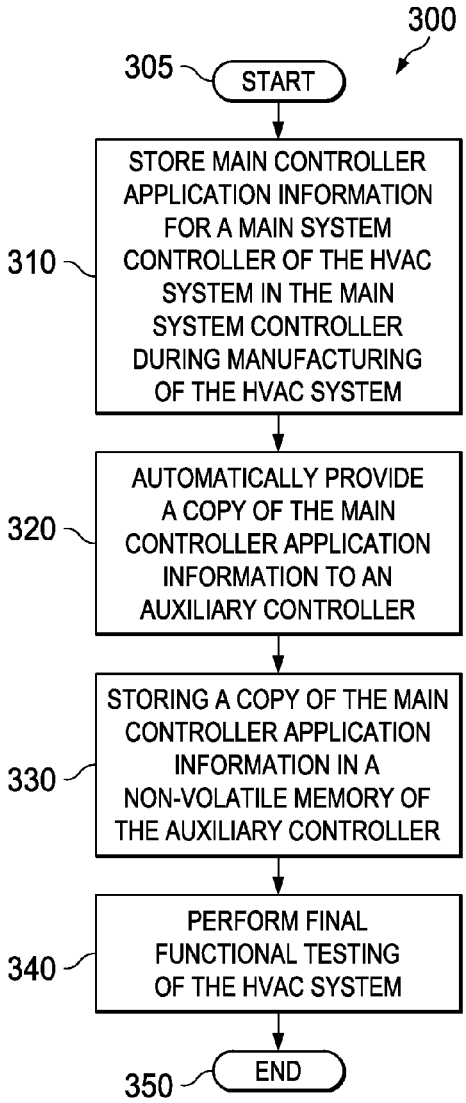
FIG. 3 is a flow diagram of an embodiment of a method of manufacturing a HVAC system carried out according to the principles of the disclosure.

FIG. 3 is a flow diagram of an embodiment of a method 300 of manufacturing a HVAC system carried out according to the principles of the disclosure. The HVAC system may be a furnace, a coil blower unit, a commercial unit, a residential unit, a rooftop unit, etc. The method begins in a step 305.

Main controller application information for a main system controller of the HVAC system is stored in the main system controller during manufacturing of the HVAC system in a step 310. In some embodiments, the main controller application information may be loaded onto the main system controller during final functional testing. The main controller application information may be automatically loaded on the main system controller. The main controller application information may be automatically loaded after the final functional testing or may be loaded as part of the final functional testing. A factory programmer may automatically load the main controller application information.

In a step 320, a copy of the main controller application information is automatically provided to the auxiliary controller. In one embodiment, the copy may be automatically transferred from the main system controller to the auxiliary controller. The main system controller may be configured to automatically transfer the main controller application information upon receipt thereof. As such, the main system controller may be programmed to automatically transfer a copy of the main controller application information to a designated auxiliary controller having a non-volatile memory after receiving the main controller application information. The copy may be transferred via a system bus that couples the main system controller and the auxiliary controller. The system bus may be wireless or wired. In some embodiments, a copy of the main controller application information may be sent to more than one auxiliary controller employing, for example, the system bus.

A copy of the main controller application information is then stored in a memory of the auxiliary controller in a step 330. The main controller application information is stored in a non-volatile memory of the auxiliary controller. In some embodiments, the main controller application information may be stored simultaneously or substantially simultaneously on the main system controller and the auxiliary controller. As such, in these embodiments the main controller application information can also be sent simultaneously or substantially simultaneously to the main system controller and the auxiliary controller. The factory programmer may be configured to send the main controller application information to both of the controllers at the same or substantially the same time.

In a step 340, final functional testing of the HVAC system is performed. The functional testing may be performed by the manufacturer to ensure each component is working correctly and each of the components is working together. The functional testing may also be applied to assess the response to and the recovery from a power failure. Final functional testing is typically performed on a HVAC system before shipment from the manufacturer. The final functional testing for a particular component, such as a main system controller, may be performed by the OEM of that component. Final functioning of the HVAC system may be performed by the manufacturer of the HVAC system or HVAC unit. The method 300 then ends in a step 350.

Figure 4:
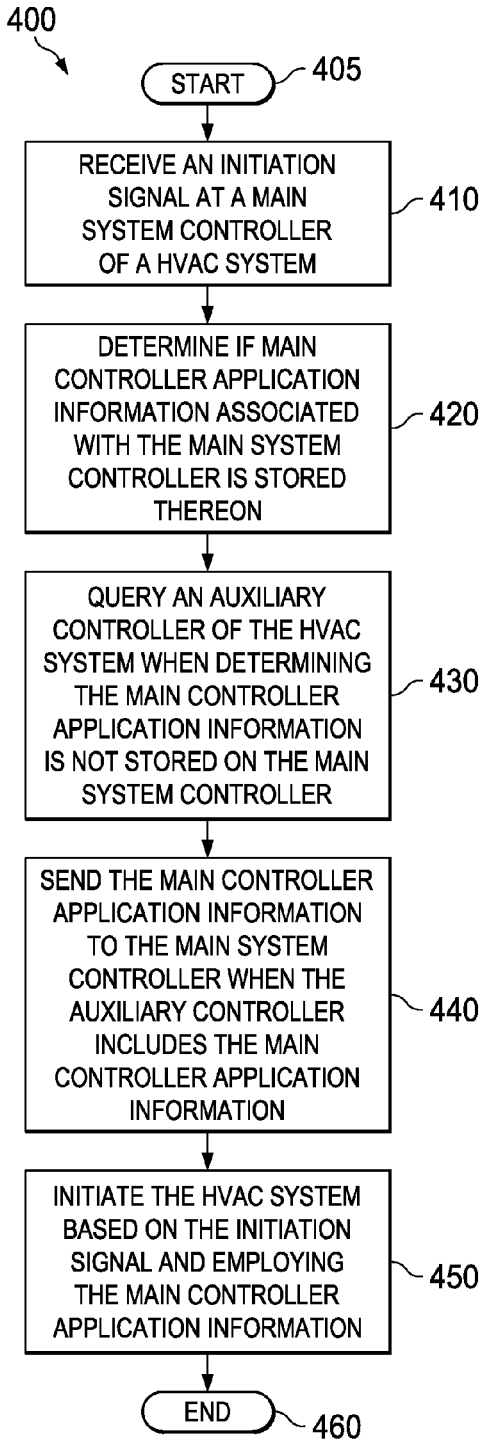
FIG. 4 is a flow diagram of an embodiment of a method of starting a HVAC system carried out according to the principles of the disclosure.

FIG. 4 is a flow diagram of an embodiment of a method 400 of starting a HVAC system carried out according to the principles of the disclosure. The HVAC system may be turned-on simply after being turned-off. Alternatively, the HVAC system may be started after being out-of-service due to repairs or maintenance. In some embodiments, the HVAC system may be turned-on after replacing the main system controller. The method 400 may be reflected as a series of operating instructions representing an algorithm for starting the HVAC system. The operating instructions or some of the operating instructions may be stored on a main system controller and an auxiliary controller. Thus, a processor or processors may be configured to perform the various steps of the method 400. The method 400 starts in a step 405.

In a step 410, an initiation signal is received at a main system controller of the HVAC system. The initiation signal is a power-up signal that can be generated via the operation of a switch. A technician may start the initiation signal by depressing a switch.

After powering-up, a determination is made in a step 420 if the main controller application information associated with the main system controller is stored thereon. The determination may be automatically started based on receipt of the initiation signal. If the main controller application information is not stored on the main system controller, an auxiliary controller is queried in a step 430 to determine if the auxiliary controller includes the main controller application information. If the auxiliary controller includes the main controller application information, the auxiliary controller sends the main controller application information to the main system controller in a step 440. Both the querying and the sending are performed automatically. The main system controller and the auxiliary controller can be programmed accordingly to automatically perform these steps. The HVAC system is then initiated in a step 450 employing the controller application information. The method 400 ends in a step 460.

Those skilled in the art to which this application relates will appreciate that other and further additions, deletions, substitutions and modifications may be made to the described embodiments. One skilled in the art will understand that the order of the steps of the various methods disclosed herein may vary unless specifically noted otherwise.

What is claimed is:

1. An auxiliary controller of a heating, ventilating and air conditioning (HVAC) system, comprising:

an interface coupled to a main system controller of said HVAC system and configured to communicate therewith, said main system controller having main controller application information stored thereon;

a processor, coupled to said interface and configured to direct the operation of an auxiliary component of said HVAC system, wherein said auxiliary component is one of a plurality of HVAC components in said HVAC system; and a non-volatile memory configured to receive a copy of said main controller application information via said interface and store said main controller application information thereon.

2. The controller as recited in claim 1 wherein said main controller application information includes model identification data or model specific data for said main system controller.

3. The controller as recited in claim 1 wherein said main controller application information includes application specific data for said main system controller.

4. The controller as recited in claim 1 wherein said auxiliary controller is an indoor blower motor controller for said HVAC system.

5. The controller as recited in claim 1 wherein said interface is configured to receive said main controller application information from said main system controller during manufacturing.

* * * * *